US007108484B2

(12) United States Patent
Thenaisie et al.

(10) Patent No.: US 7,108,484 B2
(45) Date of Patent: Sep. 19, 2006

(54) RESTRAINING DEVICE FOR FAN BLADE ROOT

(75) Inventors: Anne Thenaisie, Guesde (FR); Alain Bassot, Bois le Roi (FR); Eric Inghels, Melun (FR); Hervé Buisson, Savigny le Temple (FR); Christophe Follonnier, Ponthierry (FR); Patrick Reghezza, Vaux le Penil (FR); Bruce Pontoizeau, Paris (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/517,611

(22) PCT Filed: Jun. 25, 2003

(86) PCT No.: PCT/FR03/01955

§ 371 (c)(1),
(2), (4) Date: Jun. 15, 2005

(87) PCT Pub. No.: WO2004/003390

PCT Pub. Date: Jan. 8, 2004

(65) Prior Publication Data

US 2005/0254951 A1 Nov. 17, 2005

(30) Foreign Application Priority Data

Jun. 27, 2002 (FR) ..... 02/07977

(51) Int. Cl.
*F01D 5/32* (2006.01)

(52) U.S. Cl. ..... 416/221; 416/500

(58) Field of Classification Search ..... 416/219 R, 416/219 A, 220 R, 220 A, 221, 248, 500
See application file for complete search history.

(56) References Cited

U.S. PATENT DOCUMENTS 3,216,699 A * 11/1965 Schoenborn ..... 416/220 R
5,123,813 A 6/1992 Przytulski et al.
5,820,347 A 10/1998 Bussonnet et al.
6,447,253 B1 * 9/2002 Tempere ..... 416/221

FOREIGN PATENT DOCUMENTS

EP 1 209 322 5/2002

* cited by examiner

*Primary Examiner*—Christopher Verdier
(74) *Attorney, Agent, or Firm*—Oblon, Spivak, McClelland, Maier & Neustadt, P.C.

(57) ABSTRACT

A restraining device for a fan blade root, in which a packing member is constituted by a metal structure having hollowed out portions filed in by overmolding with a semi-rigid elastomer material, in particular on a lateral edge concave side between an upstream end zone and a downstream end zone, which end zones are entirely of metal structure, on a lateral edge convex side between the end zones and a central zone that is essentially of metal structure, and on two top portions of the packing member that extend between the elastomer lateral edges on either side of the metal central zone. The metal structure also includes a bottom recess extending over its entire surface between the upstream end zone and the downstream end zone. Hence, the metal structure behaves like a spring blade when the blade turns following a violent impact.

4 Claims, 2 Drawing Sheets

RESTRAINING DEVICE FOR FAN BLADE ROOT

The invention relates to a device for retaining the root of a fan blade.

More precisely, the invention relates to a packing member for retaining the root of a blade in a fan in a curved socket arranged on the periphery of a rotor disk, said blade having a convex flank and a concave flank, said packing member being in the form of a curvilinear plate constituted by a metal structure having hollowed out portions that are filled in by overmolding with a semi-rigid elastomer material, in particular on the lateral edge situated on the concave side of the blade between an upstream end zone and a downstream end zone, which end zones are entirely of metal structure, on the lateral edge situated on the convex side of the blade between said end zones and a central zone, that is essentially of metal structure, and on the two top portions of said packing member which extend between said two elastomer lateral edges on either side of said metal central zone.

Such a packing member is described in FR 2 746 456 which represents the prior art closest to the invention. Those packing members engaged under the blade roots serve to damp blade vibration, thereby preventing the blade roots from tilting while centrifugal forces are low, and allowing the root of a blade to turn to some extent when forces are extreme, such as when the blade is impacted by a body that has been ingested by the fan, for example, in order to avoid said blade breaking at its root. To this end, the metal central zone has a machined profile set back relative to the profile of the socket.

In that document, the packing member comprises a bottom metal part which lies on the bottom of the socket, said bottom part being disposed between the two lateral edges made of elastomer, on either side of the metal central zone.

If the blade undergoes a violent impact, the plate can pivot through a very limited angle only owing to the high stiffness of the metal structure.

The object of the invention is to improve the behavior of the impacted blade by ensuring that the packing member can absorb some of the impact energy beyond the turning permitted by the prior art packing member.

The invention achieves this object by the fact that the metal structure further comprises a bottom recess extending over its entire surface between the upstream end zone and the downstream end zone.

Hence, if the blade receives a violent impact, the packing member functions on the principle of a leaf spring.

In order to improve the flexibility of the packing member further, the bottom recess is advantageously connected to the upstream and downstream end zones by crescent-shaped portions.

Preferably, the bottom recess is filled in by being overmolded with the semi-rigid elastomer material.

If necessary, the central zone has a profile that is set back relative to the profile of the socket.

Other characteristics and advantages of the invention appear on reading the following description, given by way of example and with reference to the accompanying figures, in which.

Figure 1:
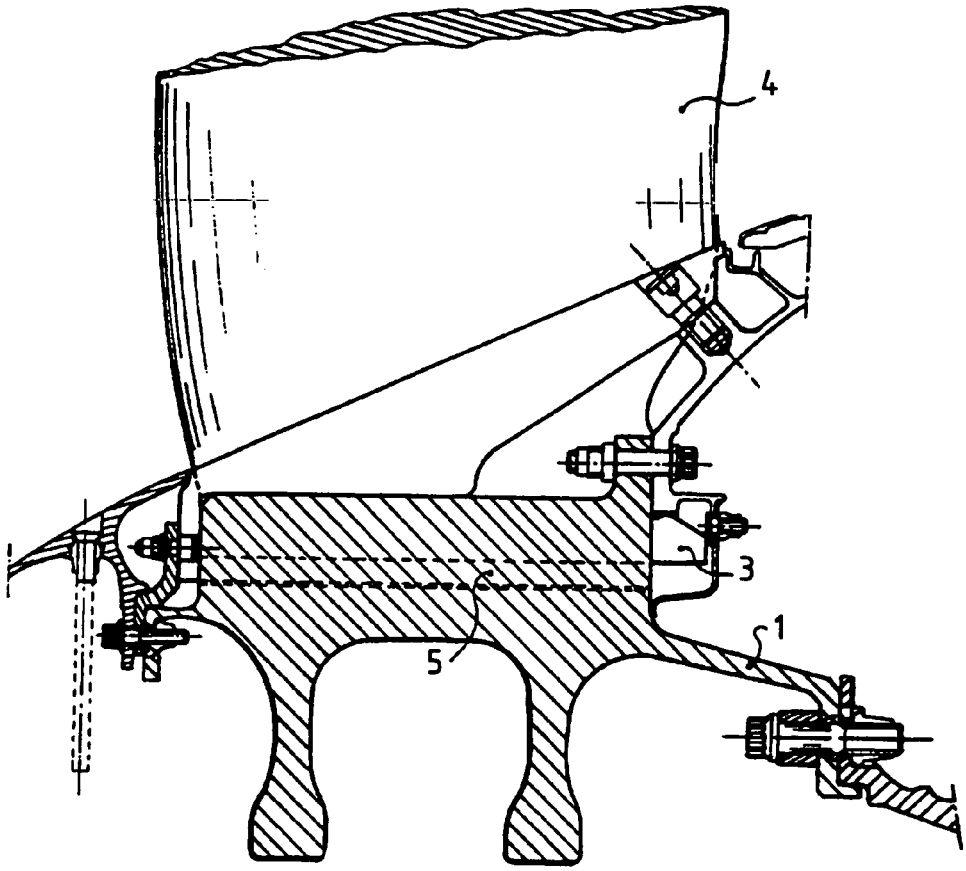
FIG.1 PRIOR ART
FIG. 1 is a radial section of a device for retaining the blade root of a fan.
Figure 2:
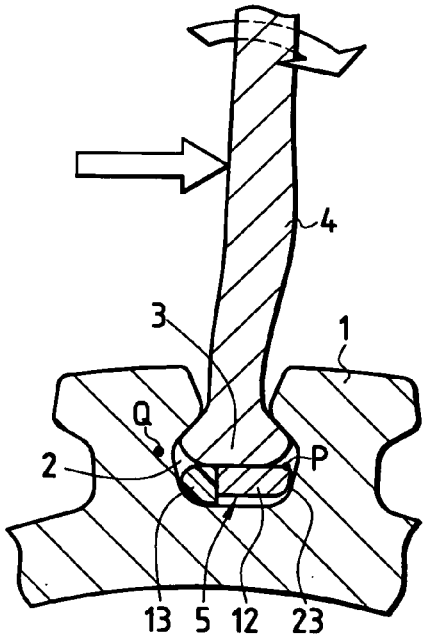
FIG. 2 is a cross-section of a blade root housed in a socket and held by means of a packing member of the invention.

FIGS. 1 and 2 show a fan rotor disk 1 which presents a plurality of curvilinear sockets 2 on its periphery, and each socket has the root 3 of a blade 4 engaged therein by sliding. The root 3 presents a section in the shape of a dovetail. An elastic packing member 5 is engaged between the root 3 of the blade 4 and the bottom of the socket 2, said packing member holding the root 3 against the walls of the socket 2.

Figure 3:
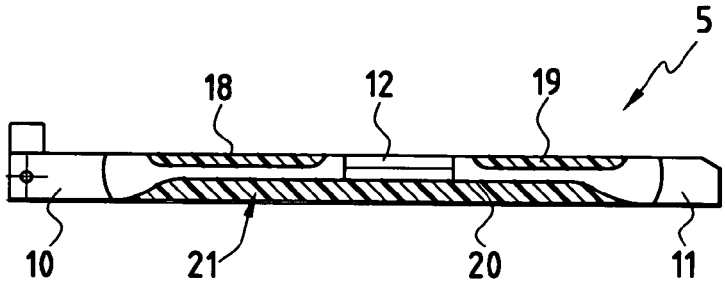
FIG. 3 is a longitudinal sectional view of a packing member for retaining a blade root of the invention.
Figure 4:
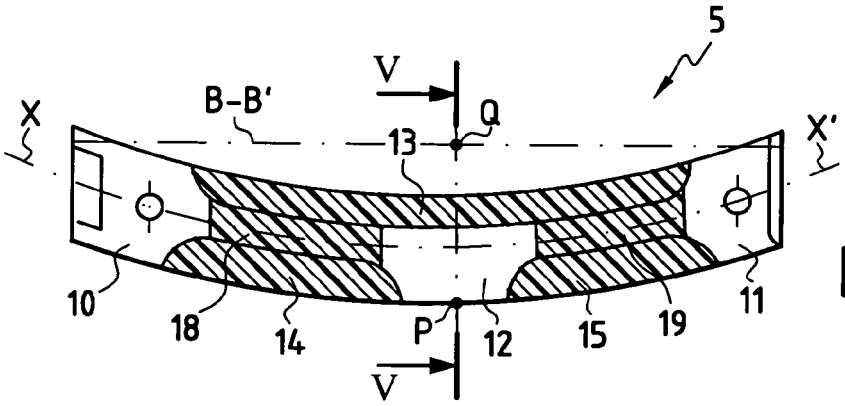
FIG. 4 is a plan view of the FIG. 3 packing member.
Figure 5:
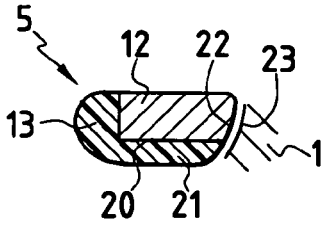
FIG. 5 is a section on the line V-V in FIG. 4.

The packing member 5 shown in FIGS. 3, 4, and 5 comes in the form of a curved plate of longitudinal axis XX'. The packing member is constituted by a metal structure having hollowed-out portions filled in by overmolding with a semi-rigid elastomer material.

The packing member 5 has an upstream end zone 10 and downstream end zone 11 that are of entirely metal structure, and that are connected to each other by an intermediate metal portion of varying section which presents:

- on its face situated on the concave side of the blade 4, a recess 13 filled in by an elastomer material forming a lateral edge which extends between the upstream and downstream end zones 10 and 13;
- on its face situated on the convex side of the blade 4, two recesses 14, 15 disposed on either side of a metal central zone 12 of metal structure, and also filled in by the elastomer material;
- on its top face on either side of the metal central zone 12, between the recess 13 and the recesses 14 and 15, two recesses 18 and 19 filled in by the elastomer material; and
- on its bottom face 20, between the upstream and downstream end zones 10 and 11, a recess 21 which extends over this entire surface and in particular under the metal central zone 12.

The bottom face 20 of the metal intermediate portion connecting the upstream and downstream end zones 10 and 11 made entirely of metal is therefore in a plane that is substantially parallel to the plane containing the bottom faces of the upstream and downstream end zones 10 and 11. Hence, the metal intermediate portion behaves like a spring blade when it is subjected to compression forces particularly when they are applied over the metal central zone 12.

The bottom recess 21 may optionally be filled in by the elastomer material, but this is not essential.

The metal structure receives overmolding of elastomer material to a thickness that is slightly greater than that of the metal portion. Such a disposition makes it possible to assemble the packing member 5 in compression under the root 3 of the blade 4 in order to eliminate the residual play between the packing member 5 and the blade root in the socket 2 of the disk 1.

When the bottom recess 21 is filled in with elastomer material, the cross section of the packing member 5 is substantially uniform from one end of the packing member 5 to the other.

Nevertheless, if necessary, the metal central zone 12 may present a machined profile 22 that is set back relative to the profile 23 of the socket 2 in order to enable the root 3 of the blade 4 to pivot about the axis BB' if the concave side of the blade 4 receives a violent impact.

The axis BB' intersects the transverse mid-plane of the packing member 5 at the point referenced Q in FIGS. 2 and 4, and is off-set away from the blade 4 due to the fact that the socket 2 is curved. When the blade 4 is impacted, it is the end P of the metal middle zone 12 that moves farthest during pivoting of the blade 4. Movement from the point P is made easier than in the prior art by the fact that the metal intermediate portion of the packing member 5 has been made thinner and includes a recess 21 in its bottom face 20.

Figure 6:
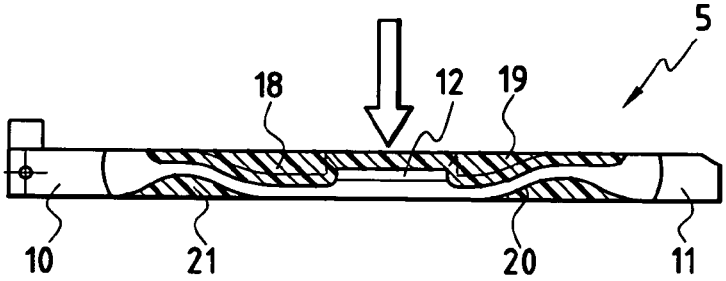
FIG. 6 is a longitudinal sectional view of the retention packing member of the invention subjected to a compression force following turning of the blade.

FIG. 6 shows the deformation experienced by the metal intermediate portion of the packing member 5 when the blade 4 receives a violent impact.

The depth of the recess 21 may be determined in such a manner that the packing member 5 functions like a spring, while preserving its elasticity. The depth may also be determined so that the packing member 5 undergoes plastic deformation and absorbs some of the energy from the impact.

Figure 7:
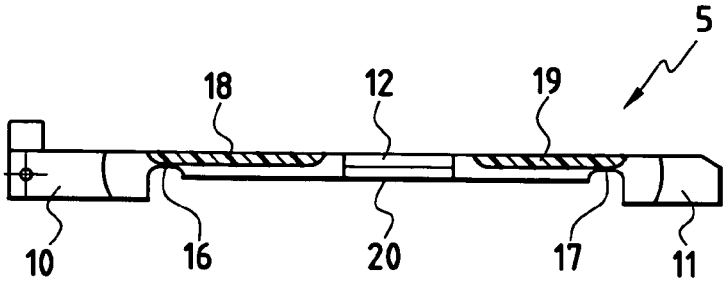
FIG. 7 is a longitudinal section of a variant of the retention packing member of the invention.

In order to increase still further the flexibility of the packing member 5, the bottom face of the intermediate portion may be connected to the upstream and downstream end zones 10 and 11 by crescent shapes 16 and 17, as shown in FIG. 7.

The invention claimed is:

1. A packing member for retaining a root of a blade in a fan in a curved socket arranged on a periphery of a rotor disk, the blade having a convex flank and a concave flank, the packing member being in a form of a curvilinear plate constituted by a metal structure having hollowed out portions filled in by overmolding with a semi-rigid elastomer material, on a lateral edge situated on a concave side of the blade between an upstream end zone and a downstream end zone, which end zones are of entirely metal structure, on a lateral edge situated on a convex side of the blade between the end zones and a central zone, that is essentially of metal structure, and on two top portions of the packing member that extend between the two elastomer lateral edges on either side of the metal central zone, wherein the metal structure further comprises a bottom recess extending over its entire surface between the upstream end zone and the downstream end zone, and wherein the bottom recess is connected to the upstream end zone and downstream end zone by crescent-shaped portions.

2. A packing member according to claim 1, wherein the central zone has a profile that is set back relative to a profile of the socket.

3. A packing member for retaining a root of a blade in a fan in a curved socket arranged on a periphery of a rotor disk, the blade having a convex flank and a concave flank, the packing member being in a form of a curvilinear plate constituted by a metal structure having hollowed out portions filled in by overmolding with a semi-rigid elastomer material, on a lateral edge situated on a concave side of the blade between an upstream end zone and a downstream end zone, which end zones are of entirely metal structure, on a lateral edge situated on a convex side of the blade between the end zones and a central zone, that is essentially of metal structure, and on two top portions of the packing member that extend between the two elastomer lateral edges on either side of the metal central zone, wherein the metal structure further comprises a bottom recess extending over its entire surface between the upstream end zone and the downstream end zone, and wherein the bottom recess is filled in by being overmolded with the semi-rigid elastomer material.

4. A packing member according to claim 3, wherein the central zone has a profile that is set back relative to a profile of the socket.

* * * * *